US009017190B2

(12) United States Patent
Hulbert

(10) Patent No.: US 9,017,190 B2
(45) Date of Patent: Apr. 28, 2015

(54) BALL SAFETY NETTING SYSTEMS

(71) Applicant: Sportsfield Specialties, Inc., Delhi, NY (US)

(72) Inventor: Eric W. Hulbert, Walton, NY (US)

(73) Assignee: Sportsfield Intellectual, LLC., Delhi, NY (US)

( * ) Notice: Subject to any disclaimer, the term of this patent is extended or adjusted under 35 U.S.C. 154(b) by 174 days.

(21) Appl. No.: 13/681,680

(22) Filed: Nov. 20, 2012

(65) Prior Publication Data

US 2014/0141906 A1 May 22, 2014

(51) Int. Cl.
*A63B 67/00* (2006.01)
*A63B 71/02* (2006.01)

(52) U.S. Cl.
CPC ..... *A63B 71/022* (2013.01)

(58) Field of Classification Search
USPC ..... 473/470; 116/173; 104/173.2; 403/2; 43/43.12
See application file for complete search history.

(56) References Cited

U.S. PATENT DOCUMENTS

| | | | | |
|---|---|---|---|---|
| 2,889,162 | A * | 6/1959 | Norris | 403/2 |
| 3,280,521 | A * | 10/1966 | Keathly | 52/40 |
| 4,035,092 | A * | 7/1977 | Adams, Jr. | 403/2 |
| D316,601 | S | 4/1991 | Shichman | |
| 5,122,007 | A | 6/1992 | Smith | |
| 5,599,129 | A | 2/1997 | Clifton et al. | |
| 5,730,442 | A | 3/1998 | Anderson | |
| 5,792,010 | A | 8/1998 | Allen et al. | |
| 5,795,253 | A | 8/1998 | Allen | |
| 5,951,416 | A | 9/1999 | Allen et al. | |
| 5,954,600 | A | 9/1999 | Gill | |
| 6,312,350 | B1 | 11/2001 | White | |
| 6,402,643 | B1 | 6/2002 | Gill | |
| 6,485,373 | B1 * | 11/2002 | Stephens | 473/197 |
| 7,396,302 | B1 | 7/2008 | Boudreau | |
| 7,441,983 | B2 | 10/2008 | Gelfand | |
| 7,690,859 | B2 | 4/2010 | Metzger | |
| 7,901,155 | B2 | 3/2011 | Metzger | |
| 8,002,492 | B2 | 8/2011 | Gelfand | |

(Continued)

FOREIGN PATENT DOCUMENTS

| | | |
|---|---|---|
| CA | 2109849 | 9/1993 |
| CA | 2153743 | 7/1996 |

OTHER PUBLICATIONS

Webpage download, guelphtwines2011, 2011, web.archive.org/web/20110610153911/http://www.guelphtwines.com/specs.aspx, 2 pages.*

(Continued)

*Primary Examiner* — Gene Kim
*Assistant Examiner* — M Chambers
(74) *Attorney, Agent, or Firm* — Heslin Rothenberg Farley & Mesiti P.C.

(57) ABSTRACT

A ball safety netting system includes a net comprising a plurality of openings, a plurality of elongated poles having a lower end operably attachable to the ground in spaced-apart relationship, and a plurality of safety devices operably attachable to the plurality of poles and operably attachable to the net. The plurality of poles and the plurality of safety devices are operably sized and configured for use in supporting the net in a generally fixed upright relationship relative to the ground, and when a force exerted on the safety device exceeds a breaking point of the safety device, a portion of the net is detaches from the pole to reduce the likelihood of pole failure.

27 Claims, 10 Drawing Sheets

(56) References Cited

U.S. PATENT DOCUMENTS

| | | | | |
|---|---|---|---|---|
| 2003/0224884 | A1* | 12/2003 | Oister et al. | 473/478 |
| 2005/0218391 | A1 | 10/2005 | Gelfand | |
| 2007/0140791 | A1 | 6/2007 | Gelfand | |
| 2007/0160421 | A1 | 7/2007 | Gelfand | |
| 2014/0141906 | A1* | 5/2014 | Hulbert | 473/415 |

OTHER PUBLICATIONS

Breakaway Swivels, available from Greenlee Textron Inc. / Subsidiary of Textron Inc., Rockford, Illinois, 4-pages, 1996.
Breakaway Connectors, available from DCD Design & Manufacturing Ltd., Richmond, BC, Canada, 4-pages, at least as early as Apr. 2011.
Ball Safety Netting Systems Brochure, Sportsfield Specialties, Inc., Delhi, New, York, 4-pages, Mar. 2011.
8'-10' Straight Ball Safety System with 2" Diameter Poles Installation Instructions, Sportsfield Specialties, Inc., Delhi, New, York, 7-pages, Mar. 2011.
12'-20' Ball Safety System with 4" Diameter Straight Poles Installation Instructions, Sportsfield Specialties, Inc., Delhi, New, York, 7-pages, Mar. 2011.
12'-20' Ball Safety Systems with 4" Diameter, Arced Poles Installation Instructions, Sportsfield Specialties, Inc., Delhi, New, York, 8-pages, 2009.
20'-40' Ball Safety Systems with 6" Diameter Straight Poles Installation Instructions, Sportsfield Specialties, Inc., Delhi, New, York, 7-pages, 2009.
20'-40' Ball Safety System with 6" Diameter Arced Poles Installation Instructions, Sportsfield Specialties, Inc., Delhi, New, York, 7-pages, 2009.
30'-40' Football Goal Post Ball Safety System with 6" Diameter Poles Installation Instructions, Sportsfield Specialties, Inc., Delhi, New, York, 7-pages, 2009.
8'-10' Portable Ball Safety System with 2" Diameter Poles Installation Instructions, Sportsfield Specialties, Inc., Delhi, New, York, 7-pages, 2010.

* cited by examiner

BALL SAFETY NETTING SYSTEMS

FIELD OF THE INVENTION

This disclosure relates generally to ball safety netting systems, and more specifically, to ball safety netting systems in which a net, supported by a plurality of poles, is designed to automatically come down during periods of sustained high winds or ice build-up thereby inhibiting the likelihood of failure of the poles.

BACKGROUND OF THE INVENTION

Conventional ball safety netting systems offer protection to athletes, coaches, officials, and spectators from balls leaving the field of play. Some ball safety system nets are held up at the top of a pole by a quick clip, or a quick clip attached to a tether hanging from a pulley to facilitate the raising and lowering of the net.

For example, for lacrosse and field hockey applications, particularly when the fields are located within a running track or other confined space, 8-foot to 10-foot high ball safety netting systems are often employed. The system includes a straight 2-inch aluminum pole, quick-clip net attachment, and a 1¾ inch square mesh net. The net is fixedly attached along the top and the bottom of the poles. The systems also include slidable guide rings to retain the net to the poles along the middle of the poles. Ground sleeves with corresponding caps allow for a semi-permanent installation so that the poles can be removed as necessary. Typical installations occur across the ends and/or down the sidelines of the playing surface. Portable ball safety netting systems employ a portable base plate assembly. Locking pin connections allows the poles and base plate assembly to be disconnected for transport and storage. Sand bags may be employed to weigh down the base plate assembly.

For use on soccer fields, baseball/softball backstops, football goal post back-up nets, or in the segregation of playing fields from residential land or property, 12-foot to 40-foot high ball safety netting systems are often employed. Typically, 12-foot to 20-foot high ball safety netting systems include 4-inch aluminum poles, while 20-foot to 40-foot ball safety netting systems typically include 6-inch aluminum or steel poles. The poles may be straight or curved. Block pulleys and tethers allow for raising and lowering the heavy net having 1¾ inch or 4-inch square mesh depending on the application. The net is fixedly attached along the bottom of the poles. The systems also include slidable rope guide rings to retain the net to the poles along the middle of the poles.

There is a need for further improvements in ball safety netting systems, and more specifically, to ball safety netting systems in which a net, supported by a plurality of poles, is designed to automatically come down during periods of sustained high winds or ice build-up thereby inhibiting the likelihood of failure of the poles.

SUMMARY OF THE INVENTION

In a first aspect, the present disclosure provides a ball safety netting system which includes a net comprising a plurality of openings, a plurality of elongated poles having a lower end operably attachable to the ground in spaced-apart relationship, and a plurality of safety devices operably attachable to the plurality of poles and operably attachable to the net. The plurality of poles and the plurality of safety devices are operably sized and configured for use in supporting the net in a generally fixed upright relationship relative to the ground, and when a force exerted on the safety device exceeds a breaking point of the safety device, a portion of the net detaches from the pole to reduce the likelihood of pole failure.

In a second aspect, the present disclosure provides a method for retaining a net to a plurality of poles. The method includes providing a ball safety netting system with a plurality of spaced-apart poles and a plurality of safety devices for use in operably supporting the net in a generally fixed upright relationship relative to the ground, and automatically allowing at least a portion of the net to detach from the pole to reduce the likelihood of pole failure when a force exerted on the safety device exceeds a breaking point of the safety device.

BRIEF DESCRIPTION OF THE DRAWINGS

The subject matter which is regarded as the disclosure is particularly pointed out and distinctly claimed in the concluding portion of the specification. The disclosure, however, may best be understood by reference to the following detailed description of various embodiments and the accompanying drawings in which:

DETAILED DESCRIPTION OF THE INVENTION

The present disclosure is directed to outdoor ball safety netting systems which may protect spectators from balls leaving the field of play and which may allow the nets to automatically come down on their own, for example, during periods of sustained high winds or ice build-up, in order to prevent pole failure and potentially cause spectator injury and/or property damage. As described in greater detail below, in one aspect, a ball safety netting system may include a plurality of safety devices. When the force exerted by the net on a safety device reaches the ultimate break strength, predetermined force, or breaking point of the safety device, the safety device is designed to operably disconnect from the net so that the net slides down the pole to the ground or falls to the ground. Since the poles are designed to withstand forces greater than that of the safety device, the poles will likely remain intact. With the replacement or reconnection of the failed safety devices, the net may be readily raised to be fully functional again.

Figure 1:
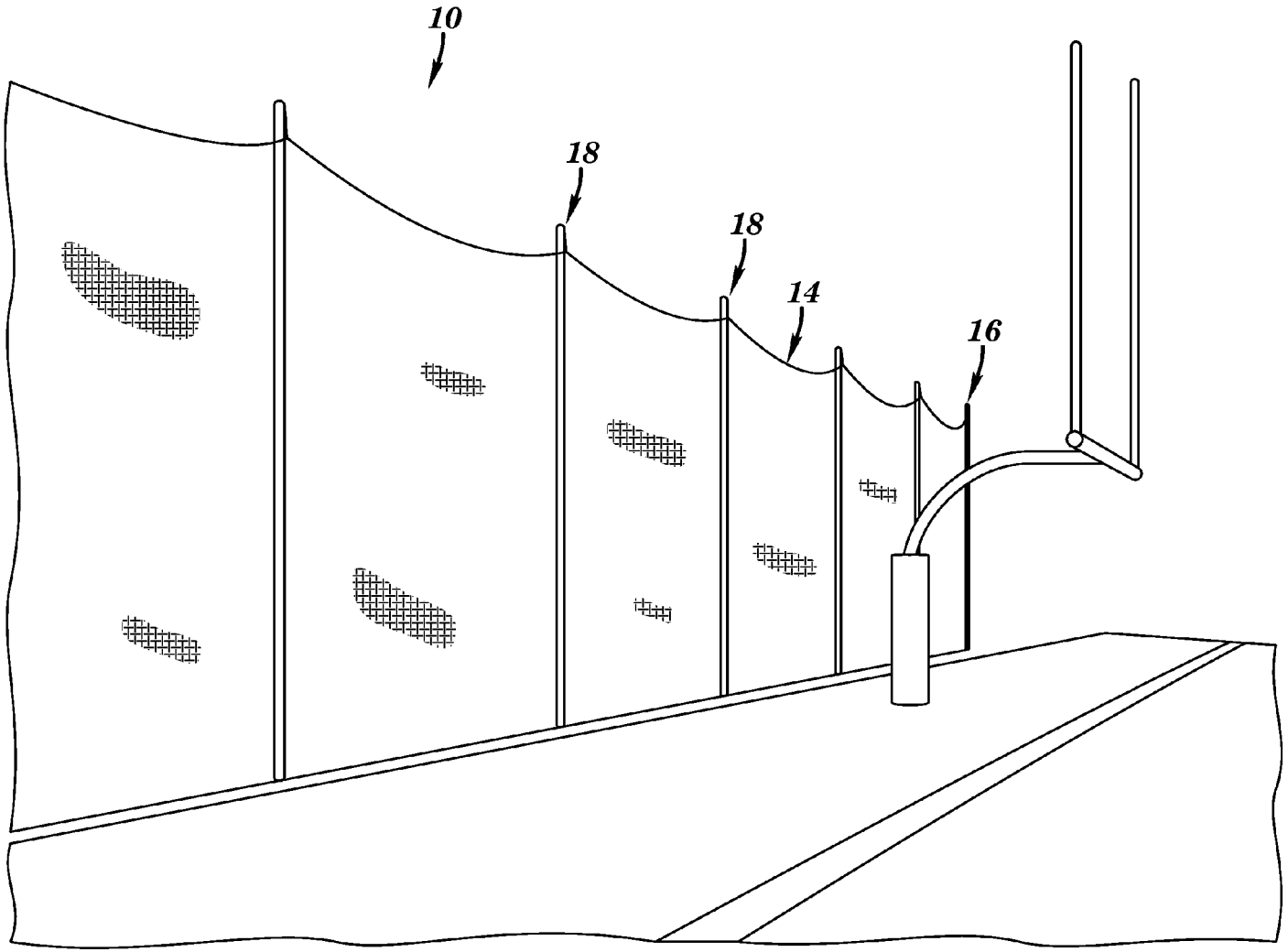
FIG. 1 is a perspective view of one embodiment of a ball safety netting system in accordance with aspects of the present disclosure.

FIG. 1 illustrates one embodiment of a ball safety netting system 10 in accordance with aspects of the present disclosure. System 10 generally includes a plurality of generally upwardly-extending, spaced-apart, elongated poles 16 and 18 and a net 14. The poles may be vertically-extending poles.

Figure 2:
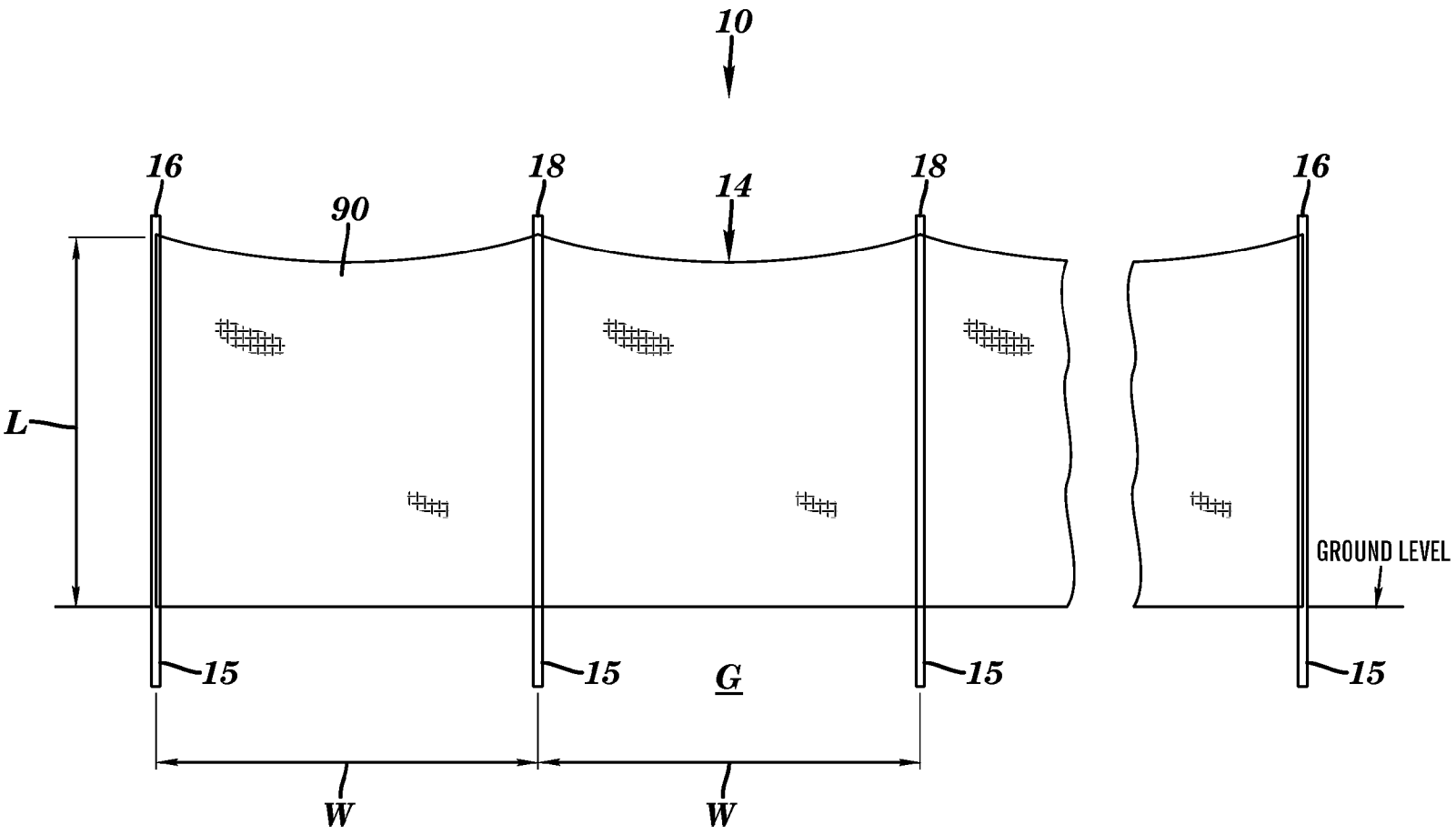
FIG. 2 is a side elevational view of a portion of the ball safety netting system of FIG. 1.

As shown in FIG. 2, the plurality of poles in system 10 may include end poles 16 and middle or inner poles 18. The net may include a plurality of openings. For example, the net may include a plurality of generally square-shaped openings having a height and a width of about 1¾ inch to about 4 inches. The system may be attached to the ground G. For example, the poles may be received in a plurality of sleeves 15 disposed in the ground. If the run is not straight but has a bend, the pole at the bend is typically referred to as a corner pole.

Figure 3:
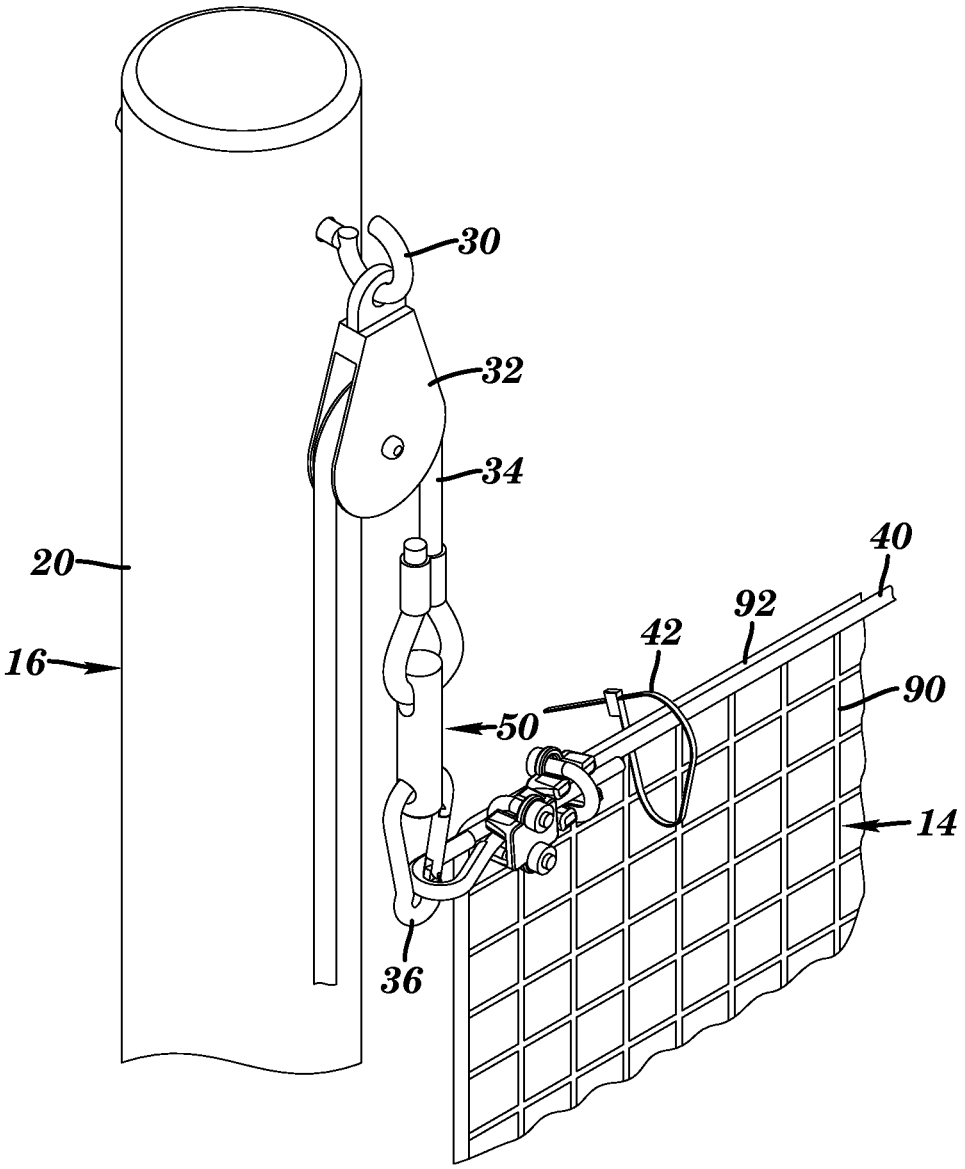
FIG. 3 is a perspective view of an upper portion of a pole, an upper portion of the net, and a first embodiment of a safety device of the ball safety netting system of FIG. 2.
Figure 4:
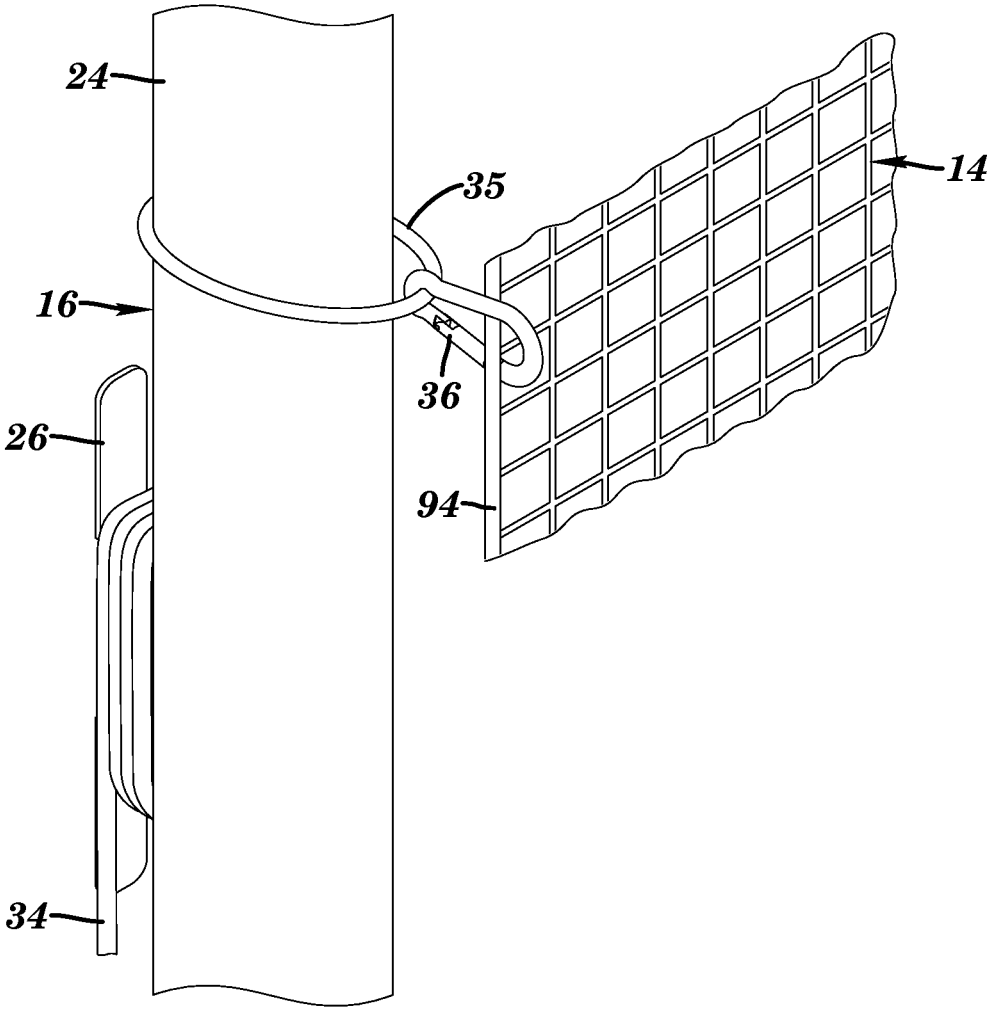
FIG. 4 is a perspective view of a middle portion of the pole and a middle portion of the net of the ball safety netting system of FIG. 2.
Figure 5:
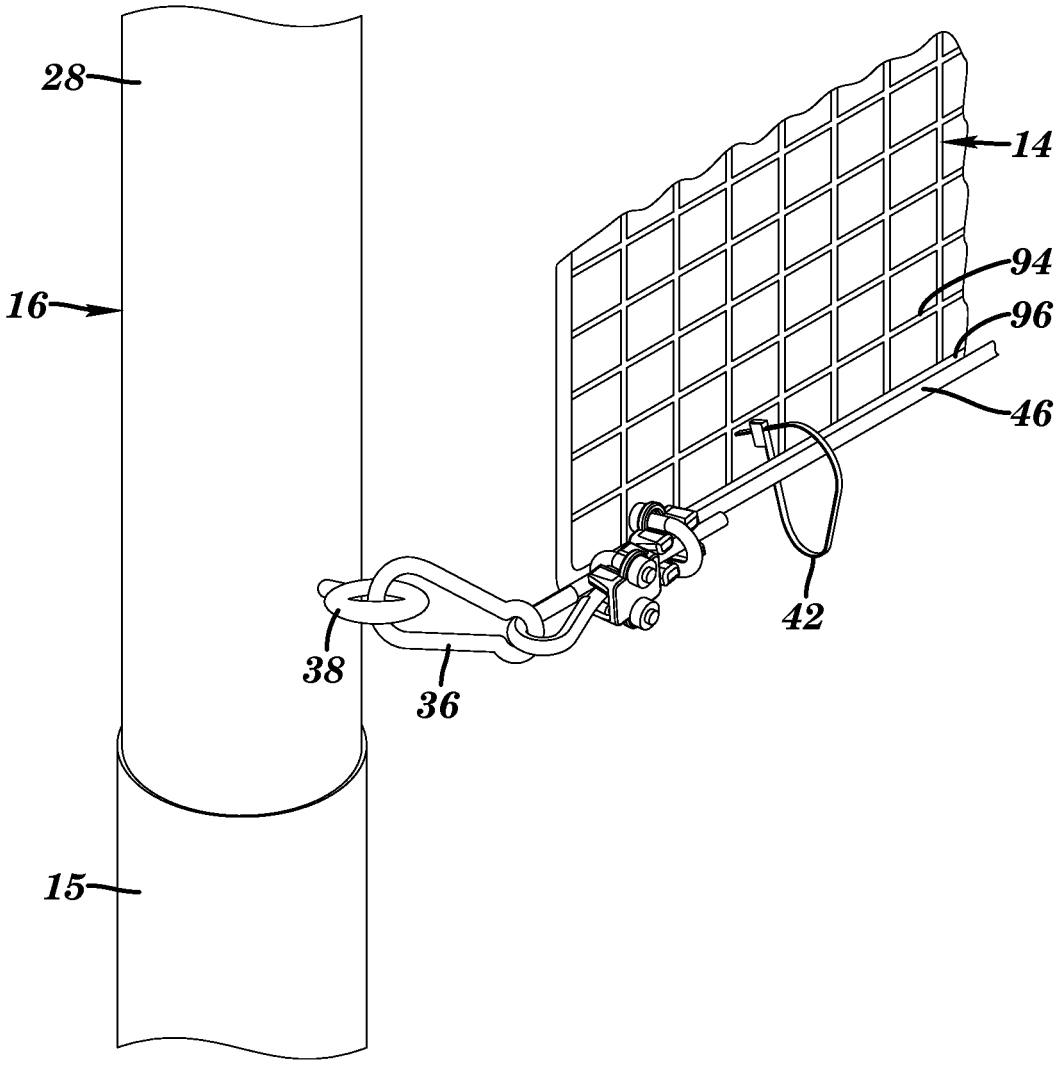
FIG. 5 is a perspective view of a lower portion of the pole and a lower portion of the net of the ball safety netting system of FIG. 2.

FIGS. 3-5 illustrate one embodiment of the attachment of net 14 to end pole 16 in accordance with aspects of the present disclosure. With reference to FIG. 3, an upper portion 20 of end pole 16 may include an open eye bolt 30 which supports a pulley 32 through which a rope or tether 34 operably attaches to a safety device 50. Safety device 50 may attach to a quick connect spring clip 36 which operably attaches to a generally horizontally-extending wire rope 40 which operably supports an upper portion 90 of net 14. The end of the wire rope may be formed into a loop which tightly fits around a rope thimble. The loop is maintained by clamping the wire rope with two rope clips so that the thimble does not fall out. The wire rope may be a black vinyl coated wire rope. A plurality of zip ties 42 may be used to attach wire rope 40 to upper portion 90 of net 14. For example, using zip ties, the wire rope may be fastened to an upper net binding 92, with the rope weaved through the square mesh of the net approximately every 12 inches to 18 inches. The zip ties may be fastened approximately every foot along the net. The wire rope may run the entire length of the net and be pulled taut.

As shown in FIG. 4, a net guide ring 35 may slidably extend around a center portion 24 of end pole 16 and may operably connect to a quick connect spring clip 36 which operably attaches to a generally vertically-extending binding 94 of net 14. A cleat 26 may be attached to middle portion 24 of end pole 16 to secure an end of tether 34.

As shown in FIG. 5, a bottom portion 28 of end pole 16 may be received and disposed in ground sleeve 15. For example, the ground sleeve may have a length of about 24 inches to 60 inches. A closed eye hook 38 may be operably secured to end pole 16 and operably attached to quick connect spring clip 36. Quick connect spring clip 36 may operably attach to a wire rope 46 disposed along a lower portion 94 of net 14. A plurality of zip ties 42 may be used to attach wire rope 46 to lower portion 94 of net 14. The steps above for attaching the wire rope and the zip ties to the upper net binding may be similarly employed along a bottom net binding 96 of net 14. The middle poles may be similarly attached to the net as shown in FIGS. 3-5.

As further described below, safety devices may be operably attached to the upper portions of the poles. In one embodiment, safety devices may be operably attached to all of the upper portions of the poles. The safety devices may be operably sized and configured to hold the upper portion of the net in a generally fixed relationship relative to the poles, and to allow portions of the net to at least one of operably detach and fall from the plurality of poles upon exceeding a predetermined force on the safety devices to inhibit the likelihood of one or more of the plurality of poles failing to remain generally upright. In one aspect, the safety device may be operably sized and configured to fail or break at a predetermined force between about 135 pounds to about 160 pounds, and the safety devices may be desirably operably sized and configured to fail or break at a predetermined force about 150 pounds.

Figure 6:
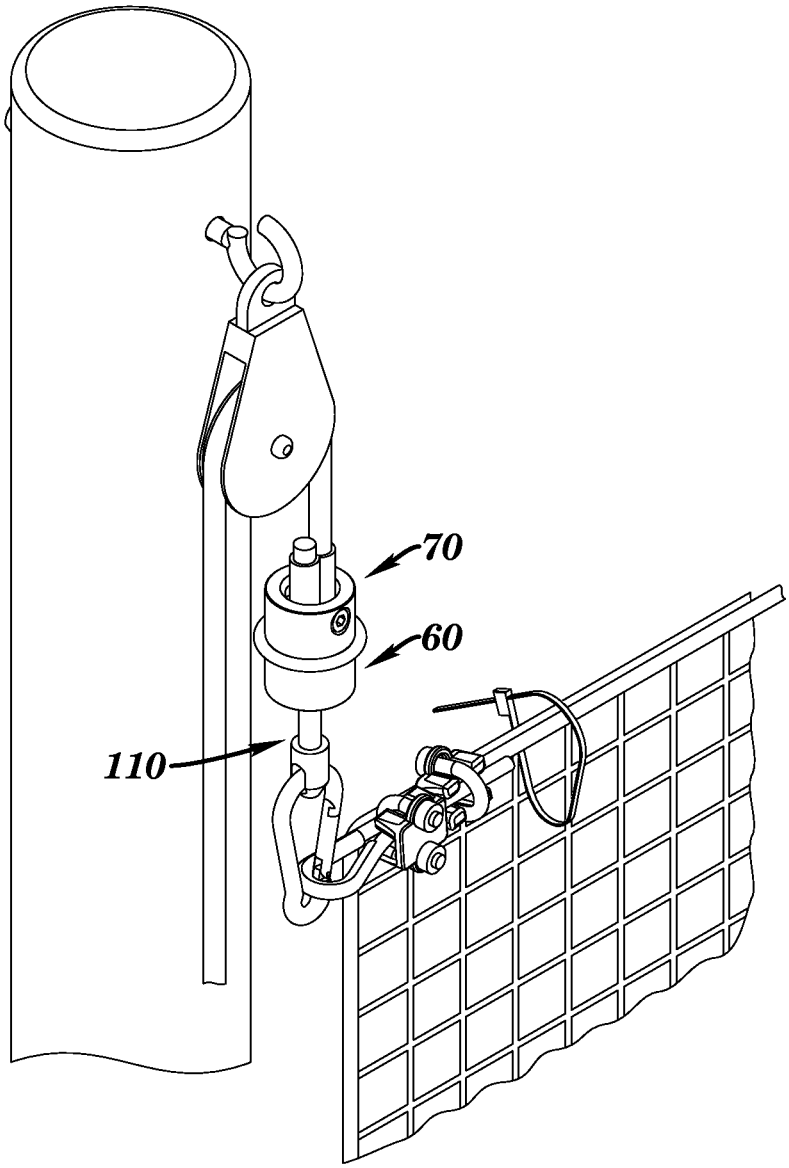
FIG. 6 is a perspective view of another embodiment of a safety device configured as a breakaway pin in accordance with aspects of the present disclosure.

With reference to FIG. 6, in one embodiment a safety device may be configured as a breakaway pin 60 in accordance with aspects of the present disclosure. For example, breakaway pin 60 may generally include a first end portion 70 and a second end portion 110. First end portion 70 may operably attach to a pole such as by a tether, and second end portion 110 may operably attach to a portion of the net.

Figure 7:
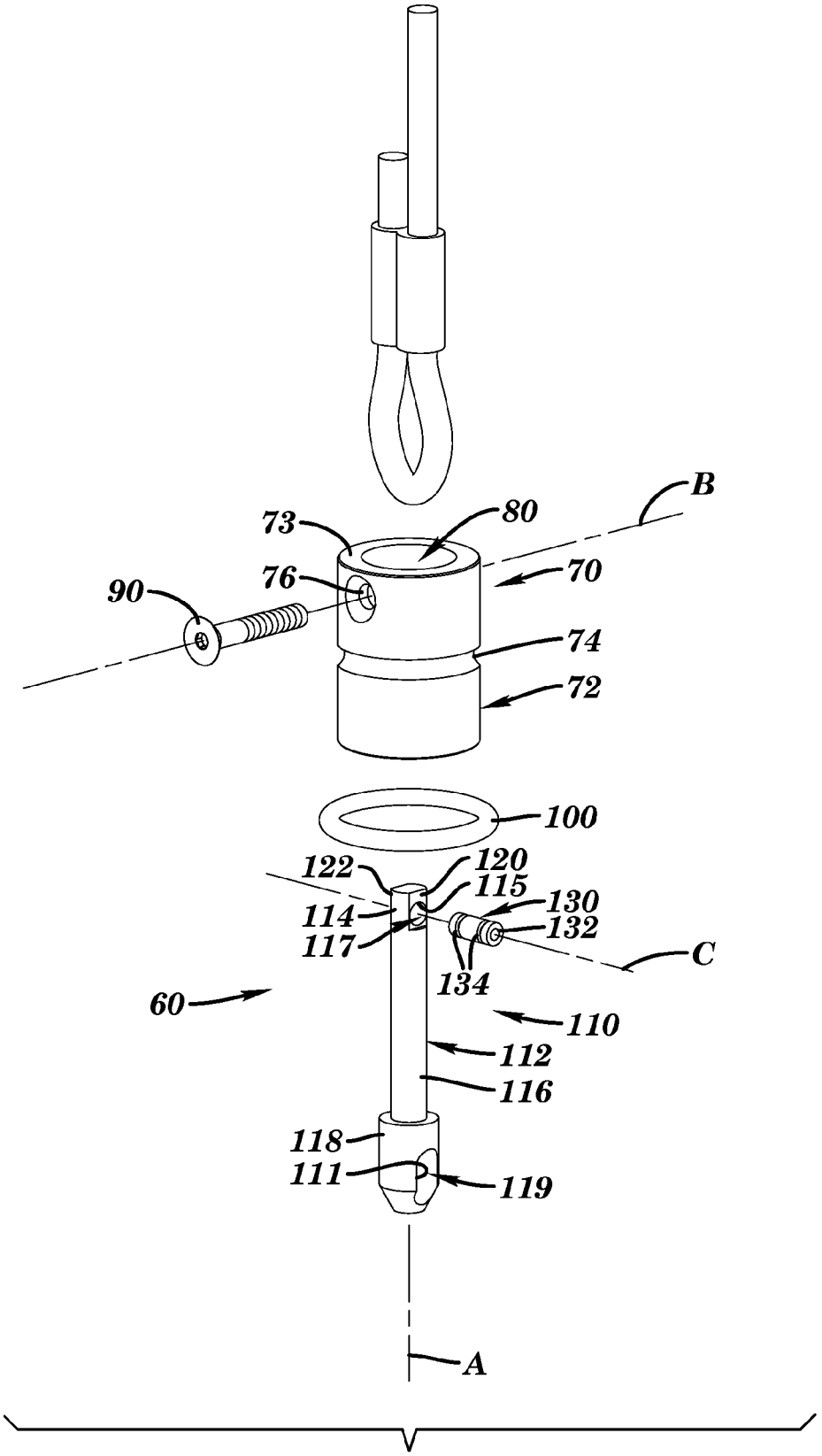
FIG. 7 is an exploded perspective view of the breakaway pin of FIG. 6.

As shown in FIG. 7, first end portion 70 and second end portion 110 may have a generally elongated configuration defining a longitudinally extending axis A. First end portion 70 of breakaway pin 60 may include a generally hollow cylindrical member 72 having a sidewall 73 defining a cavity 80 disposed therein. A rubber absorption pole bumper 100 may be received in a groove 74 disposed around an outer surface of cylindrical member 72. An upper portion of hollow cylindrical member 72 may include a first aperture 76 such as a countersunk hole extending through sidewall 73 which is aligned with a second aperture 78 (FIG. 8) such as a threaded hole extending through sidewall 73 for receiving a screw or bolt 90 for operably attaching first end portion 70 to, for example, a tether, which operably attaches to a pole. Aperture 76 and 78 may define an axis B aligned and disposed normal to axis A.

Second end portion 110 of breakaway pin 60 may include an elongated member 112 having an upper end 114, an elongated mid section 116, and a lower end 118 having an oblong aperture 111 defining a passageway 119 extending therethrough. A quick connect spring clip is operably received in aperture 119 for operably attaching second end portion 110 to a generally horizontally-extending wire rope which operably supports an upper portion of a net. Upper end 114 of second end portion 110 may include an opening or hole 115 which defines a passageway 117 that extends across upper end portion 114. Upper end 114 may include opposite flat surfaces 120 and 122. Passageway 117 including an axis C disposed normal to axis A.

To releasably connect first end portion 70 to second end portion 110, a shear pin 130 may be disposed in passageway 117. Sheer pin 130 may be solid or include a passageway 132 disposed therethrough. Shear pin 130 may also be provided with a pair of spaced-apart reliefs 134 or circumferentially extending grooves. The grooves may be aligned and disposed adjacent to flat surfaces 120 and 122 when the shear pin is received in the assembled breakaway pin.

Figure 8:
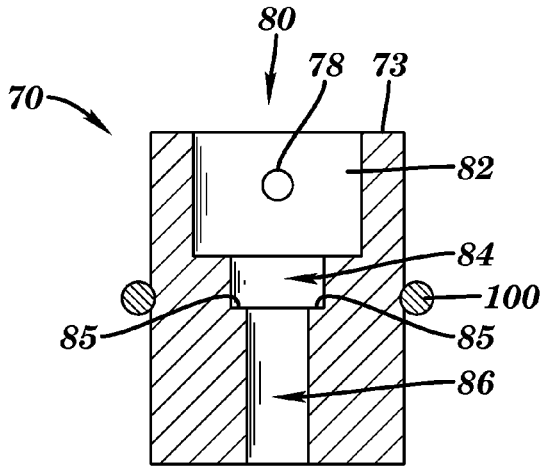
FIGS. 8 and 9 are enlarged, partially cutaway views of the breakaway pin of FIG. 7.

With reference to FIG. 8, first end portion 70 may include sidewall 73 having passageway 80 disposed therein. For example, passageway 80 may comprises an upper passageway portion 82, a middle passageway portion 84, and a lower passageway portion 86. Upper passageway portion 82 may be sized for receiving a looped end of a tether, and lower passageway portion 86 may be sized for receiving elongated end 112 (FIG. 9) of second end portion 110 (FIG. 9) of the breakaway pin. Sidewall 73 may define a landing or stop 85 disposed between middle passageway portion 84 and lower passageway portion 86.

Figure 9:
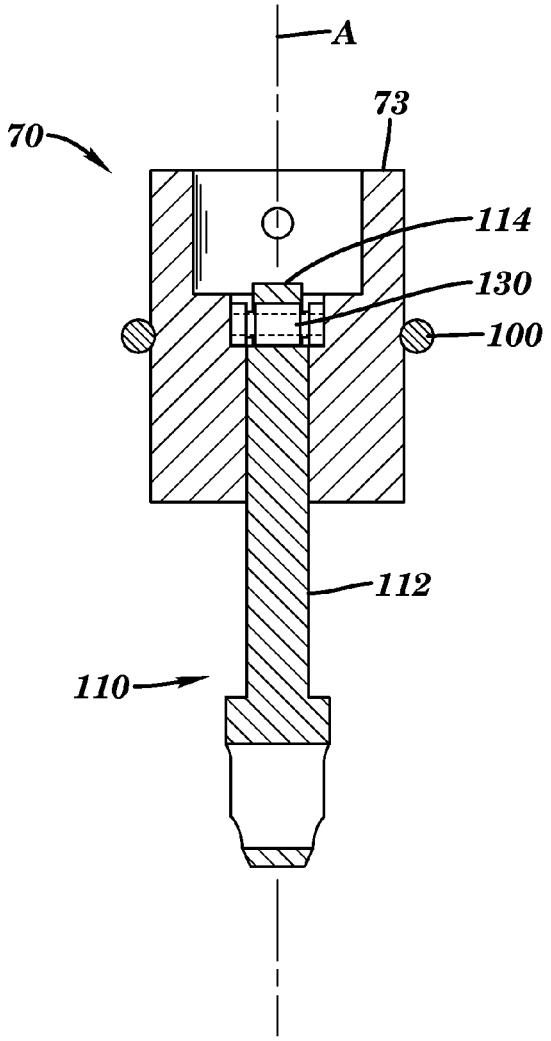

As best shown in FIG. 9, elongated end 112 of second end portion 110 of the breakaway pin may be inserted in lower passageway portion 86. The upper end 114 may be made to extend from upper passageway portion 82 so shear pin 130 may be inserted in passageway 117 (FIG. 7) of second end portion 110. Thereafter, second end portion 110 may be slid downwardly so that ends 136 and 138 (best shown in FIG. 10)

of shear pin 130 rest on landing or stop 85 as shown in FIG. 9. For example, landing or stop 85 may be a circular stop thereby allowing second end portion 110 and shear pin 130 to rotate 360 degrees relative to first end portion 70 of the breakaway pin. Once the tether is attached to first end portion 70 of the breakaway pin, upper end 114 of second end portion 110 and shear pin 130 are inhibited from moving along axis A. Thus, shear pin 130 is retained in middle passageway portion 84 (FIG. 8) with the ends of the shear pin restrained from moving normal to axis A by portions of the inside of sidewall 73 forming middle passageway 84.

First end portion 70 of the breakaway pin may be formed from a solid cylinder by drilling a hole therethrough having a diameter corresponding to lower passageway portion 86. Thereafter, a first counterbore tool may be used for enlarging the hole and forming middle passageway portion 84 having a flat-bottomed recess, and a second counterbore tool having a larger diameter may be used for enlarging the hole and forming upper passageway portion 82 having a flat-bottomed recess. When the breakaway pin breaks, first end portion 70 may act as a counter weight to lower the tether, thereby allowing one to replace the broken shear pin and re-raise the net. The weight of the first end portion may be about 1 pound, and desirably about 0.8 pound.

The shear pin may be operably sized to fail or break at a predetermined force of about 150 pounds. For example, the shear pin may be generally cylindrical, hollow, and formed from 2024 T4 aluminum having an outside diameter of about ¼ inch, an inside diameter of about ⅛ inch, and the grooves having a depth of about 0.49 inch. The first end portion and the second end portion of the breakaway pin may be formed from steel. Bumper 100 may be a silicon O-ring. The breakaway pins operably attached to the end poles may be sized to fail or break at a predetermined force of about 150 pounds, and breakaway pins operably attached to the poles disposed between the end poles may be sized to fail or break at a predetermined force about 150 pounds.

With reference again to FIG. 2, the plurality of poles may have a length L of about 12 feet to about 40 feet. The poles may be spaced-apart a distance W of about 10 feet to desirably a maximum of about 25 feet.

For ball safety netting systems in accordance with aspects of the present disclosure having 12 foot to 20 foot poles, the net may be a heavy duty black #36 nylon 1¾ inch square mesh net or a heavy duty black #36 nylon 4 inch square mesh net depending on the application. The 12 foot to 20 foot inner and end poles may be fabricated from 3½ inch Schedule 40 aluminum pipe 4.0 inch outside diameter, 0.226 inch wall thickness 6061 aluminum tube. The ground sleeves may be fabricated from a 4 inch aluminum pipe about 30 inches to about 48 inches long. The spacing between the poles may be desirably a maximum of about 25 feet.

For ball safety netting systems in accordance with aspects of the present disclosure having 21 foot to 30 foot poles, the net may be a heavy duty black #36 nylon 1¾ inch square mesh net or a heavy duty black #36 nylon 4 inch square mesh net depending on the application. The 21 foot to 30 foot inner and end poles may be fabricated from 6 inch Schedule 40 aluminum pipe 6.0 inch outside diameter, 0.280 inch wall thickness 6061 aluminum tube. The ground sleeves may be fabricated from a 7 inch steel pipe about 30 inches to about 48 inches long. The spacing between the poles may be desirably a maximum of about 25 feet.

For ball safety netting systems in accordance with aspects of the present disclosure having 31 foot to 40 foot poles, the net may be a heavy duty black #36 nylon 1¾ inch square mesh net or a heavy duty black #36 nylon 4 inch square mesh net depending on the application. The 31 foot to 40 foot poles may be fabricated from 6 inch Schedule 40 aluminum pipe or steel. The ground sleeves may be fabricated from a 7 inch steel pipe about 48 inches to about 60 inches long. The spacing between the poles may be a desirably maximum of about 25 feet.

For ball safety netting systems in accordance with aspects of the present disclosure having two 30 foot to 40 foot poles such as located behind football goal posts, the net may be a heavy duty black #36 nylon 4 inch square mesh net. The two 30 foot to 40 foot poles may be fabricated from 6 inch Schedule 80 steel. The ground sleeves may be fabricated from a 7 inch steel pipe about 60 inches long. The spacing between the poles may be about 40 feet. In other embodiments of the ball safety netting systems in accordance with aspects of the present disclosure having two 30 foot to 40 foot poles such as located behind football goal posts, the poles may be 6 inch Schedule 40 steel and have a spacing ranging from about 30 feet to about 40 feet.

The various poles may be straight poles or arched poles. For arched poles, the arc may have about a 36 inch offset. Where the net is disposed away from the pole, for example in the middle portions of the poles, the rings may include an elongated member which connects the ring to a quick clip which connects to the net. The poles may have a mill finish or may be powder coated. Between the poles, closed eye bolts may be installed in the ground, which are attachable to quick clips for securing the bottom of the net between the poles to the ground.

From the present description it will be appreciated that other types of the safety devices may be sized and configured, and employed in the ball safety netting systems of the present disclosure. For example, a safety device may comprise a single elongated member having one end operably attachable to a pole and a second end operably attachable to a net. The elongated member may include a notch or groove between the first and second ends so that the elongated pin fails or breaks due to a tensional force applied on the ends of the elongated member. In addition, a safety device may be sized and configured to include two or more releasably connectable parts such as male and female connectors that operably connect together, and operably disconnect at a breaking point or predetermined force to protect the ball safety netting system. After such safety devices operably disconnect to allow the net to fall to the ground, the safety devices may be used again by reconnecting the releasably connectable parts together to again support the net from the poles. In another example, the safety devices may a single deformable element or reusable deformable or spring element. It will be appreciated that still other suitable safety devices may be employed such that when a force exerted on the safety device exceeds a predetermined force or breaking point of the safety device, the upper portion of the net disconnects from attachment to the pole. It will be appreciated that the safety device may have the same or different breaking points and may be attached to the upper portions and other portions of the net and poles.

Figure 10:
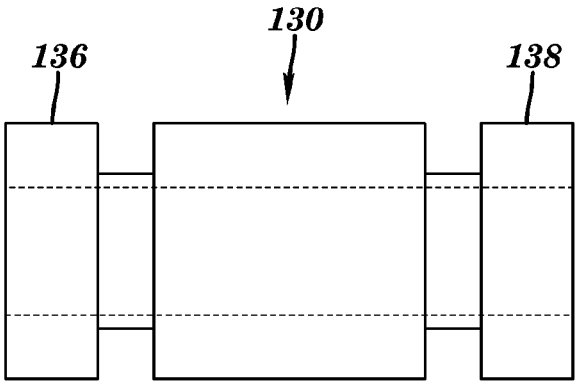
FIG. 10 is an enlarged view of the shear pin of FIG. 9.

FIG. 10 illustrates a method 200 for retaining a net of a ball safety netting system to a plurality of poles in accordance with aspects of the present disclosure. For example, method 200 includes at 210, providing a ball safety netting system having a plurality of spaced-apart poles and a plurality of safety devices operably supporting a net in a generally fixed upright relationship relative to the ground, and at 220, automatically allowing at least a portion of the net to detach from the pole to reduce the likelihood of pole failure when a force exerted on the safety device exceeds a breaking point of the safety device.

Figure 11:
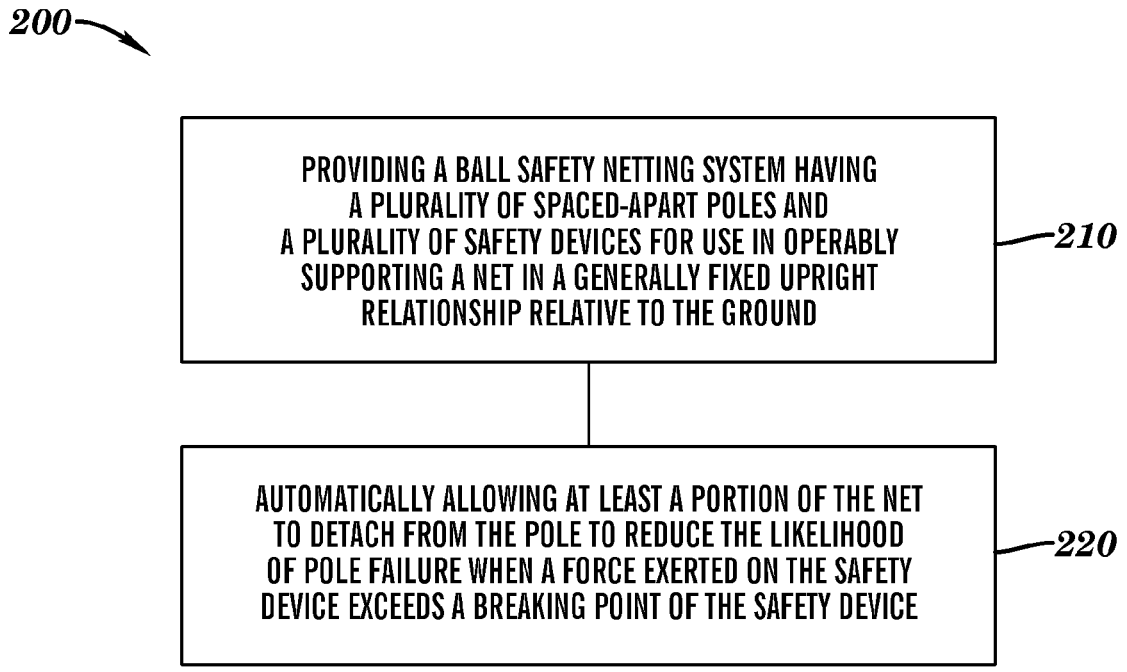
FIG. 11 is flowchart of one embodiment of a method for detachably retaining a net to a plurality of poles in accordance with aspects of the present disclosure.
Figure 12:
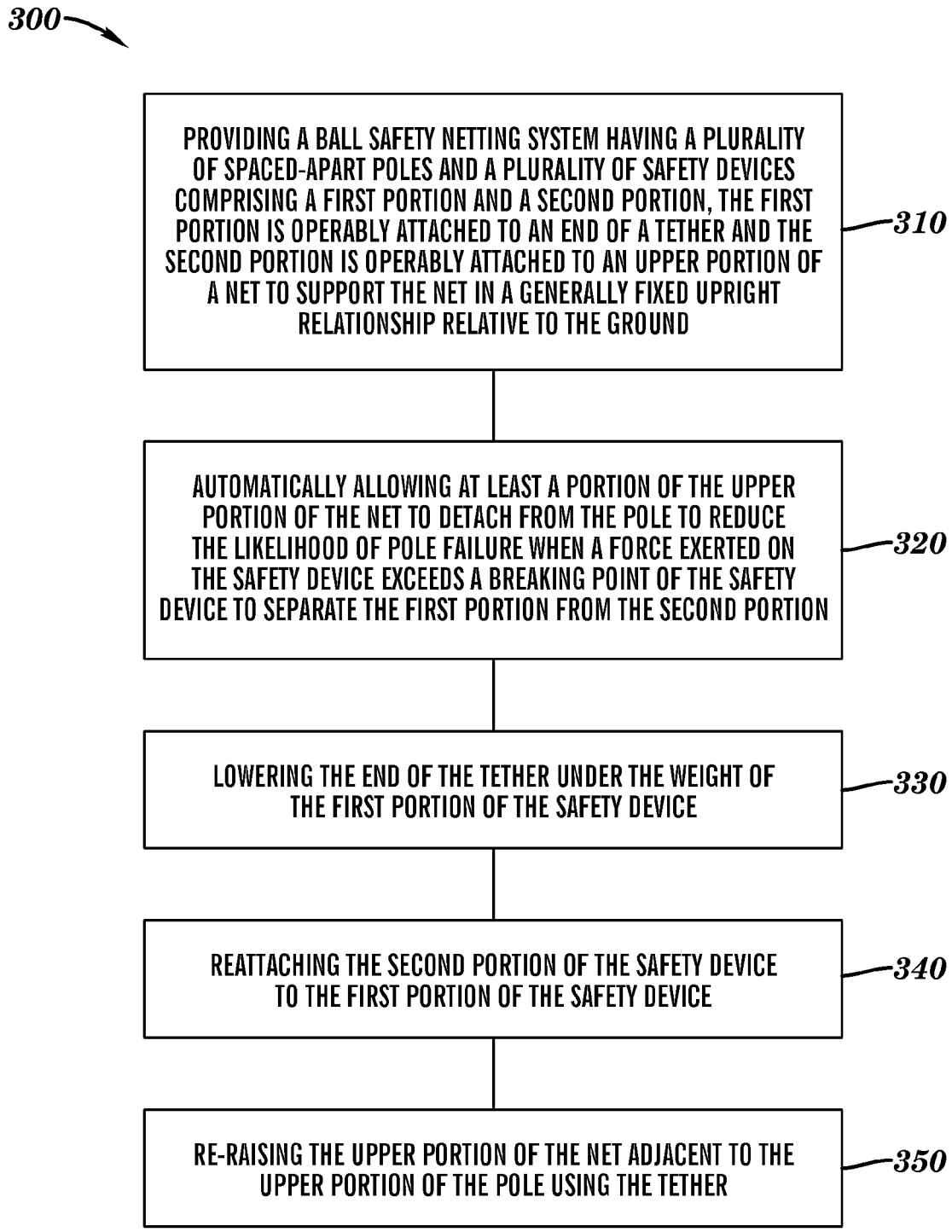
FIG. 12 is flowchart of another embodiment of a method for retaining a net to a plurality of poles in accordance with aspects of the present disclosure.

FIG. 11 illustrates a method 300 for detachably retaining a net of a ball safety netting system to a plurality of poles in accordance with aspects of the present disclosure. For example, method 300 includes at 310, providing a ball safety netting system having a plurality of spaced-apart poles and a plurality of safety devices comprising a first portion and a second portion, the first portion is operably attached to an end of a tether and the second portion is operably attached to an upper portion of a net to support the net in a generally fixed upright relationship relative to the ground. At 320, at least a portion of the upper portion of the net is automatically allowed to detach from the pole to reduce the likelihood of pole failure when a force exerted on the safety device exceeds a breaking point of the safety device to separate the first portion from the second portion. At 330, the lower end of the tether is lowered under the weight of the first portion of the safety device, and at 340, the second portion of the safety device is reattached to the first portion of the safety device. At 350, the upper portion of the net is raised adjacent to the upper portion of the pole using the tether.

Although ball safety netting systems should be taken down and stored while not in use especially during the off season, many users fail to follow these recommendations. If there is snow or ice buildup on the nets, the extra weight can cause stress on the poles resulting in pole failure. With sustained high winds, the nets can begin whipping against the poles and can also cause them to break. From the present description, with the use of safety devices, the likelihood of pole failure is reduced, if not eliminated. For example, the safety devices holding up the nets may be designed for ultimate break strengths that are less than the poles. Thus, when higher than normal forces are exerted by the net against the poles, the safety devices will break which will allow the nets to come down in a controlled manner and thereby reducing the chances of catastrophic pole failures. Thus, the present disclosure overcomes pole failures that can occur when loads on the net attached to the poles are dramatically increased due to a build-up of ice and snow or during sustained periods of high winds.

From the present description, it will further be appreciated by those skilled in the art that the size, such as the diameter and wall thickness of the poles, may be operably reduced when using the safety devices of the present disclosure compared to the size of the poles in conventional systems. In addition, the use of the safety devices of the present disclosure may allow for greater spacing between the poles.

Thus, while various embodiments of the present disclosure have been illustrated and described, it will be appreciated to those skilled in the art that many changes and modifications may be made thereunto without departing from the spirit and scope of the disclosure.

The invention claimed is:

1. A ball safety netting system comprising:

a net comprising a plurality of openings;

a plurality of elongated poles having a lower end operably attachable to the ground in spaced-apart relationship, said plurality of poles comprising a length between about 12 feet to about 40 feet;

a plurality of pulleys and tethers operably attachable to upper portions of said plurality of poles;

a plurality of breakaway pins operably attachable to said plurality of tethers and operably attachable to spaced-apart upper portions of said net, each of said breakaway pins comprising a first end portion operably attachable to an end of said tether, a second end portion operably attachable to said net, and a shear pin operably connecting said first end portion to said second end portion, said first end portion comprising a generally hollow member having a passageway therethrough defining a longitudinal axis, said second end portion comprising an elongated member having an upper end portion having a hole therethrough, said upper end portion receivable in said passageway of said generally hollow member, and said shear pin receivable in said hole and disposed normal to said longitudinal axis with ends of said shear pin enclosed in said passageway and engaging a stop defined by said passageway in said generally hollow member;

wherein said plurality of poles and said plurality of breakaway pins are operably sized and configured for use in supporting said net in a generally fixed upright relationship relative to the ground, and when a force exerted by said net on said breakaway pin exceeds a breaking point of said breakaway pin, a portion of said net detaches from said tether to reduce the likelihood of pole failure; and wherein said first end portion of said breakaway pin comprises sufficient weight to act as a counterweight to allow for lowering of said tether attached to said first end portion from said upper portion of said pole after failure of said breakaway pin wherein said breaking point comprises a force between about 125 pounds to about 175 pounds.

2. The system of claim 1 wherein said breaking point comprises a force of about 150 pounds.

3. The system of claim 2 wherein said first end portion comprises a weight of about 1 pound.

4. The system of claim 2 wherein when said breakaway pin is assembled, said second end portion and said shear pin are rotatable 360 degrees relative to said generally hollow member around said longitudinal axis.

5. The system of claim 2 wherein said first end portion comprises a weight of about 1 pound, and wherein when said breakaway pin is assembled, said second end portion and said shear pin are rotatable 360 degrees relative to said generally hollow member around said longitudinal axis.

6. The system of claim 1 wherein middle spaced-apart portions of said net are operably slidably attachable to middle portions of said poles.

7. The system of claim 6 wherein lower spaced-apart portions of said net are operably fixedly attachable to lower portions of said poles.

8. The system of claim 1 wherein said first end portion comprises a weight of about 1 pound.

9. The system of claim 1 further comprising a resilient bumper member disposed around said first end portion of said breakaway pin for absorbing impact between said breakaway pin and said pole.

10. The system of claim 1 wherein said first end portion comprises a weight of about 1 pound, and wherein when said breakaway pin is assembled, said second end portion and said shear pin are rotatable 360 degrees relative to said generally hollow member around said longitudinal axis.

11. The system of claim 1 wherein said shear pin comprises aluminum having an outside diameter of about ¼ inch.

12. The system of claim 1 wherein when said breakaway pin is assembled, said second end portion and said shear pin are rotatable 360 degrees relative to said generally hollow member around said longitudinal axis.

13. The system of claim 1 wherein said plurality of openings of said net comprises a plurality of openings between about 1 inch and about 4 inches.

14. The system of claim 1 further comprising a plurality of sleeves mountable in the ground for receiving lower ends of said plurality of poles.

15. The system of claim 1 wherein said system is disposed between at least one of adjacent playing fields, and an athletic playing field and spectators.

16. The system of claim 1 wherein said first end portion comprises a weight of about 1 pound.

17. The system of claim 16 wherein middle spaced-apart portions of said net are operably slidably attachable to middle portions of said poles, and lower spaced-apart portions of said net are operably fixedly attachable to lower portions of said poles.

18. The system of claim 1 wherein when said breakaway pin is assembled, said second end portion and said shear pin are rotatable 360 degrees relative to said generally hollow member around said longitudinal axis.

19. The system of claim 1 wherein said first end portion comprises a weight of about 1 pound, and wherein when said breakaway pin is assembled, said second end portion and said shear pin are rotatable 360 degrees relative to said generally hollow member around said longitudinal axis.

20. A method for retaining a net to a plurality of poles, the method comprising:

providing the ball safety netting system of claim 1 with the plurality of spaced-apart poles and the plurality of breakaway pins for use in operably supporting the net in a generally fixed upright relationship relative to the ground; and automatically allowing at least a portion of the net to detach from the pole to reduce the likelihood of pole failure when the force exerted on the breakaway pins exceeds the breaking point of the breakaway pin.

21. The method of claim 20 wherein the breaking point comprises a force between about 125 pounds to about 175 pounds.

22. The method of claim 20 wherein the breaking point comprises a force between about 150 pounds.

23. The method of claim 20 wherein said first end portion comprises a weight of about 1 pound.

24. The method of claim 20 wherein when said breakaway pin is assembled, said second end portion and said shear pin are rotatable 360 degrees relative to said generally hollow member around said longitudinal axis.

25. A method for retaining a net to a plurality of poles, the method comprising:

providing the ball safety netting system of claim 1 with the plurality of spaced-apart poles and the plurality of breakaway pins, the first end portion operably attached to an end of a tether and the second end portion operably attached to an upper portion of the net to operably support the net in a generally fixed upright relationship relative to the ground;

automatically allowing at least a portion of the upper portion of the net to detach from the pole to reduce the likelihood of pole failure when the force exerted on the breakaway pin exceeds the breaking point of the breakaway pin to separate the first end portion from the second end portion;

lowering the end of the tether under the weight of the first end portion of the breakaway pin;

reattaching the second end portion of the breakaway pin to the first portion of the breakaway pin, and raising the upper portion of the net adjacent to the upper portion of the pole using the tether.

26. The method of claim 25 wherein said first end portion comprises a weight of about 1 pound.

27. The method of claim 25 wherein when said breakaway pin is assembled, said second end portion and said shear pin are rotatable 360 degrees relative to said generally hollow member around said longitudinal axis.

* * * * *